US005531425A

United States Patent [19]

Skibo et al.

[11] Patent Number: 5,531,425

[45] **Date of Patent: *Jul. 2, 1996**

[54] APPARATUS FOR CONTINUOUSLY PREPARING CASTABLE METAL MATRIX COMPOSITE MATERIAL

[75] Inventors: Michael D. Skibo, Leucadia; David M. Schuster, LaJolla; Richard S. Bruski, Encinitas, all of Calif.

[73] Assignee: Alcan Aluminum Corporation, Cleveland, Ohio

[ * ] Notice: The term of this patent shall not extend beyond the expiration date of Pat. No. 4,786,467.

[21] Appl. No.: 192,950

[22] Filed: Feb. 7, 1994

Related U.S. Application Data

[63] Continuation of Ser. No. 667,558, Mar. 11, 1991, abandoned, which is a continuation-in-part of Ser. No. 259,581, Oct. 18, 1988, Pat. No. 5,167,920, which is a continuation of Ser. No. 856,338, May 1, 1986, Pat. No. 4,786,467, which is a continuation-in-part of Ser. No. 501,128, Jun. 6, 1983, abandoned.

[51] Int. Cl.[6] ..... B22B 11/00

[52] U.S. Cl. ..... 266/208; 266/235; 266/216; 164/417; 164/97

[58] Field of Search ..... 164/417, 97, 900; 266/208, 216, 235

[56] References Cited

U.S. PATENT DOCUMENTS

| | | | |
|---|---|---|---|
| 3,116,998 | 1/1964 | Pagonis | 266/208 |
| 3,343,828 | 9/1967 | Hunt | 266/208 |
| 3,626,073 | 12/1971 | Sindelar | 75/508 |
| 3,728,108 | 4/1973 | Sifferlen | 266/235 |
| 3,839,019 | 1/1974 | Bruno et al. | 266/235 |
| 3,889,348 | 6/1975 | Lemelson | 164/108 |
| 3,954,455 | 5/1976 | Flemings et al. | 148/428 |
| 3,997,336 | 12/1976 | van Linden | 266/235 |
| 4,473,103 | 9/1984 | Kenney et al. | 164/97 |
| 4,618,427 | 10/1986 | Venas | 420/580 |
| 4,759,995 | 7/1988 | Skibo et al. | 420/532 |
| 4,786,467 | 11/1988 | Skibo | 420/129 |
| 4,961,461 | 10/1990 | Klier | 164/97 |

FOREIGN PATENT DOCUMENTS

| | | | |
|---|---|---|---|
| 60-35966 | 8/1985 | Japan | 266/208 |

OTHER PUBLICATIONS

B. F. Quigley et al., "A Method for Fabrication of Aluminum–Alumina Composites", Met.Trans. A, vol. 13A, Jan. 1982 (pp. 93–100).

*Primary Examiner*—Jack W. Lavinder
*Assistant Examiner*—James Miner
*Attorney, Agent, or Firm*—Gregory Garmong

[57] ABSTRACT

A method and apparatus for preparing a continuous flow of castable composite materials of nonmetallic particles in a metallic matrix, wherein particles are mixed into a molten metallic alloy to wet the molten metal to the particles, and the particles and metal are sheared past each other to promote wetting of the particles by the metal. The mixing occurs while minimizing the introduction of gas into the mixture, and while minimizing the retention of gas at the particle-liquid interface. Mixing is done at or below a maximum temperature whereat the particles do not substantially chemically degrade in the molten metal during the time required for processing, and casting is done at a temperature sufficiently high that there is no solid metal present in the melt.

15 Claims, 5 Drawing Sheets

APPARATUS FOR CONTINUOUSLY PREPARING CASTABLE METAL MATRIX COMPOSITE MATERIAL

This application is a continuation of application Ser. No. 07/667,558, filed Mar. 11, 1991 now abandoned which is a continuation in part of application Ser. No. 07/259,581 now U.S. Pat. No. 5,167,920 filed Oct. 18, 1988, for which priority is claimed; which is a continuation of application Ser. No. 06/856,338, filed May 1, 1986, now U.S. Pat. No. 4,786,467, for which priority is claimed; which is a continuation in part of PCT application PCT/US84/02055 (which named the United States), filed Dec. 12, 1984, now abandoned, for which priority is claimed; which is a continuation in part of U.S. patent application 06/501,128, filed Jun. 6, 1989, now abandoned, for which priority is claimed.

BACKGROUND OF THE INVENTION

This invention relates to metal matrix composite materials and, more particularly, to the preparation of such materials by a continuous flow mixing process.

Metal matrix composite materials have gained increasing acceptance as structural materials. Metal matrix composites typically are composed of reinforcing particles such as fibers, grit, powder or the like that are embedded within a metallic matrix. The reinforcement imparts strength, stiffness and other desirable properties to the composite, while the matrix protects the fibers and transfers load within the composite. The two components, matrix and reinforcement, thus cooperate to achieve results improved over what either could provide on its own.

Twenty years ago such materials were little more than laboratory curiosities because of very high production costs and their lack of acceptance by designers. More recently, many applications for such materials have been discovered, and their volume of use has increased. The high cost of manufacturing composite materials remains a problem that slows their further application, and there is an ongoing need for manufacturing methods that produce composite materials of acceptable quality at a price that makes them competitive with more common substitutes such as high-strength alloys.

Unreinforced metallic alloys are usually produced by melting and casting procedures. Melting and casting are not easily applied in the production of reinforced composite materials, because the reinforcement particles may chemically react with the molten metal during melting and casting. Another problem is that the molten metal often does not readily wet the surface of the particles, so that mixtures of the two quickly separate or have poor mechanical properties after casting.

In the past, attempts to produce metal alloy-particulate composites by the addition of particulate material to the molten alloy, followed by casting the resulting mixture, have not been particularly successful. It has been postulated that the major difficulty with such an approach is that the most desirable particulates, such as, for example, silicon carbide, are not readily wetted by molten metal alloys. As a result, the introduction and retention of the particles in the liquid matrix has been extremely difficult, if not impossible.

An ability to prepare such composites by melting and casting would have important technical and economic advantages, and consequently there have been many attempts to produce such composites. It has been suggested that wettability could be achieved by coating the particles with nickel. Another technique has involved promoting wetting of the refractory particles in the melt by saturating the melt with anions of the refractory particles. Another method involves the addition of such elements as lithium, magnesium, silicon, and calcium into the melt prior to the addition of the refractory particles. Still another method involves the addition of particles of silicon carbide to a vigorously agitated, partially solidified slurry of the alloy, maintained at a temperature well below the liquidus temperature of the alloy so that solid metal particles are present. Still another attempt to improve the wettability of the particulate has involved subjecting large particulate materials and fibers in the melt to ion bombardment, mechanical agitation, vacuum, and heat prior to mixing with the molten alloy, in order to remove moisture, oxygen, adsorbed gases, and surface film therefrom.

The fabrication of aluminum alloy-alumina fiber composites in one approach uses a stirrer blade with a paddle type design, the blade being designed to move very close to the walls of the crucible to induce a high shear and create a vortex for introduction of the fibers into the melt. The process also requires a baffle, which is immersed slightly below the surface of the melt with a tilt angle of about 45° in the direction of flow. The function of the baffle is to divert the flow pattern in the melt and to aid in the entrapment of the fibers below the surface of the melt.

In yet another approach, composites such as aluminum-silicon carbide particulate composites are prepared using the vortex method of dispersion of particles. The particles are pre-heated for 60 minutes at 900° C. prior to addition to the melt to aid in their introduction into the melt. The vortex is created by stirring the melt rapidly with a mechanical impeller, which causes a deep vortex to form. The particulate is added through the sides of the vortex in an effort to promote rapid incorporation of the particles into the melt and wetting of the particles by the molten metal. Composites produced by this method tend to have poor bonding of the metal to the particulate, as well as entrapped gas.

In a variation of melting and casting techniques, the reinforcement is provided as a mat of packed material, and the molten metallic alloy is forced under pressure into the spaces remaining. This process, termed infiltration or squeeze casting, produces a composite that is not well bonded internally. Moreover, the process is expensive and difficult to use, since an apparatus specific to each part must be built.

All of these prior melting and casting techniques have drawbacks owing largely to the specialized, costly modifications that must be done to the particulate or the melted alloy, in order to accomplish wetting. Moreover, the techniques have not been successful in manufacturing composite materials for large-scale, industrial applications.

Another commercial approach for producing composites having a metal matrix and particulate reinforcement has utilized powder metallurgical techniques. In an example of the powder metallurgical processes, carefully sized aluminum powder is mixed with silicon carbide particulate in the presence of an organic solvent. A solvent is necessary to prevent a pyrophoric reaction between the aluminum and oxygen in the air. The mixture is poured into drying trays, and the solvent allowed to evaporate over a period of time. The dry, unconsolidated sheets, which are approximately 0.040 inches thick, are stacked to form a plate of the desired thickness. This fragile stack of sheets is placed into a press and heated to the liquid-solid regime of the matrix, where the metal is slushy in character. The stack is then pressed, consolidating the particles, and forming a solid plate.

In another powder metallurgical process, the silicon carbide particles and aluminum are mixed, as above, but the mixed powder is poured into a cylindrical mold, and consolidated by vacuum hot pressing into a cylindrical billet. Because of the high costs of raw materials, particularly the aluminum powders, and the complexities of the fabrication process, the current costs of the composites discourage their large-scale use in many areas. The powder processes result in considerable segregation of alloying elements in the metallic matrix material, which is undesirable because of its adverse effect on mechanical and physical properties.

Both of the commercial powder metallurgical processes above described result in composites which, while having high moduli and adequate strength, have ductility and formability which are low. The complex superheating and deformation cycle which is required in these processes produce extensive elemental segregation in the matrix, which decreases ductility and prevents the attainment of maximum matrix and composite strengths. A further problem is the retention of the surface oxide which coated the original aluminum powder particles, this serving to further decrease matrix ductility. It would also appear that the oxide coating prevents the complete wetting of the carbide particles, thus further limiting the ultimate composite properties.

There is a continuing need for further improvements using the melting and casting approach to produce metallic composites having good properties. The method and apparatus must also be acceptable in that they produce the composite materials relatively inexpensively, both as compared with other methods of manufacturing composites and with methods of manufacturing competitive materials. The present invention fulfills this need, and further provides related advantages.

SUMMARY OF THE INVENTION

The present invention provides a method and apparatus for preparing a metallic matrix composite material having wetted nonmetallic refractory ceramic particulate reinforcement dispersed throughout. The process is continuous, offering the potential for production costs reduced below those available with batch production processes, which are now about $2 per pound. The continuous flow process is suitable for the preparation of composite material for both cast and wrought applications. In the former, the composites can be cast using a wide variety of conventional and unconventional techniques. In the latter, the composite material is formable by standard industrial procedures such as rolling and extrusion into semi-finished products.

In accordance with the invention, a method for preparing a composite of a metallic alloy reinforced with a preselected volume fraction of nonmetallic particles comprises melting the metallic alloy in a continuous flow system wherein the metallic material is continuously provided to a mixer and molten composite material is continuously withdrawn from the mixer, and adding a flow of nonmetallic particulate material to the mixer, the relative flow rates of the metallic material and the particulate being adjusted to yield the preselected volume fraction of particles in the composite material. The molten metallic alloy with the particulate material is mixed in the mixer to wet the molten metal to the particles, under conditions that the particles are distributed throughout the volume of the molten mixture and the particles and the molten metal are sheared past each other to promote wetting of the particles by the metal. The mixing occurs while minimizing the introduction of gas into, and while minimizing the retention of gas within, the mixture of particles and molten metal, and at a temperature whereat the particles do not substantially chemically degrade in the molten metal in the time required to complete the step of mixing. The composite mixture withdrawn from the mixer is cast by any appropriate technique.

The process of the invention is a continuous flow method for preparing a composite material by mixing the molten metallic alloy with the reinforcement particles. Flows of the molten alloy and the particles are introduced into the mixer, where they are mixed under the proper conditions to achieve a homogeneous mixture of the wetted particulate in the melt. The flow rates of the molten alloy and the particles are controlled to achieve a preselected total flow rate, and a preselected ratio of particulate to molten metal so that the final solid composite will have a preselected volume fraction of particulate.

Preferably, the metallic material is an aluminum alloy, although other materials such as magnesium alloys can also be used. The nonmetallic particulate material is preferably a metal oxide, metal nitride, metal carbide, metal silicide, or glass. The most preferred composite material is silicon carbide or aluminum oxide particulate reinforcement in an aluminum alloy matrix.

In conventional casting procedures, it is usually desirable to cast molten metal at a high temperature to decrease the viscosity of the metal so that it can be readily cast. However, consideration of reaction of the particulate and molten alloy enters into the selection of temperature for the present method. During the mixing and casting steps, the molten metal must not be heated to too high a temperature, or there may be an undesirable reaction between the particulate and the molten metal which degrades the strength of the particulate and the properties of the finished composite. The maximum temperature is therefore chosen so that a significant degree of reaction does not occur between the particles and the metallic melt in the time required to complete processing. For the present approach, the maximum mixing and casting temperature is about 20° C. above the liquidus for metallic alloys containing volatile, reactive alloying elements, about 70° C. above the liquidus for most common metallic alloys, and about 100° C. to about 125° C. above the liquidus for metallic alloys containing alloying elements that promote resistance to reaction. However, because of the short duration of mixing, higher temperatures can be tolerated in some circumstances.

A vacuum is applied to the molten mixture of metal and particulate during the mixing step in the preferred approach. The vacuum reduces the atmospheric gases available for introduction into the melt, and also tends to draw dissolved, entrapped and adsorbed gases out of the melt during mixing. The magnitude of the vacuum is not critical for metal alloys that do not contain volatile constituents such as zinc or magnesium. However, where volatile elements are present, the vacuum is selected so that the volatile elements are not drawn out of the alloy at an unacceptably high rate. The preferred vacuum is found to provide the favorable reduction of gases, while minimizing loss of volatile elements.

The composite material made by the method of the invention has a cast microstructure of the metallic matrix, with particulate distributed generally evenly and homogeneously throughout the cast volume. The particulate is well bonded to the mat fix, since the matrix was made to wet the particulate during fabrication. No significant oxide layer is interposed between the particulate and the metallic matrix. The cast composite is particularly suitable for casting and foundry applications where the matrix alloy is a castable composition. For a composite using a wrought alloy matrix, processing is accomplished by known primary forming operations such as rolling and extruding.

Apparatus for preparing a continuous flow of a composite of a metallic alloy reinforced with a preselected volume fraction of nonmetallic particles comprises mixing means for mixing a flow of a molten metallic alloy with a flow of a particulate material to wet the molten metal to the particles, under conditions that the particles are distributed throughout the volume of the mixture and the particles and the molten metal are sheared past each other to promote wetting of the particles by the metal, the mixing to occur while minimizing the introduction of gas into, and while minimizing the retention of gas within, the mixture of particles and molten metal, and at a temperature whereat the particles do not substantially chemically degrade in the molten metal in the time required to complete the step of mixing. Metal supply means for introducing a flow of molten metal into the mixing means and particle supply means for introducing a flow of particulate into the mixing means are also provided, the metal flow rate of the metal supply means and the particle flow rate of the particle supply means being controllable. Means for removing a flow of mixed composite material from the mixing means is included.

The apparatus preferably uses one or multiple stages of mixing. If multiple stages are used, they may be accomplished in either one or multiple chambers. In each stages, the molten metal and the particulate are mixed together, as with a dispersing impeller or other technique for achieving sufficient shear of the molten metal with respect to the particulate to wet the metal to the particulate. Care is taken to prevent air or other adversely reacting gas from interfering with the wetting process, although small amounts of beneficial gases may be introduced into the mixer as needed.

It will now be apparent that the method and apparatus of the present invention present an important and significant advance in the art of manufacturing composite materials. The composite materials are produced economically by apparatus which incorporates the particulate reinforcement directly into the molten metal, without the need to coat or otherwise treat the particles before incorporation and using conventional metallic alloys. The method is economically competitive with methods of preparing unreinforced alloys, and produces composites much less expensively than do other technologies. Other features and advantages of the present invention will become apparent from the following more detailed discussion, taken in conjunction with the accompanying drawings, which illustrate, by way of example, the principles of the invention.

DETAILED DESCRIPTION OF THE PREFERRED EMBODIMENT

Figure 1:
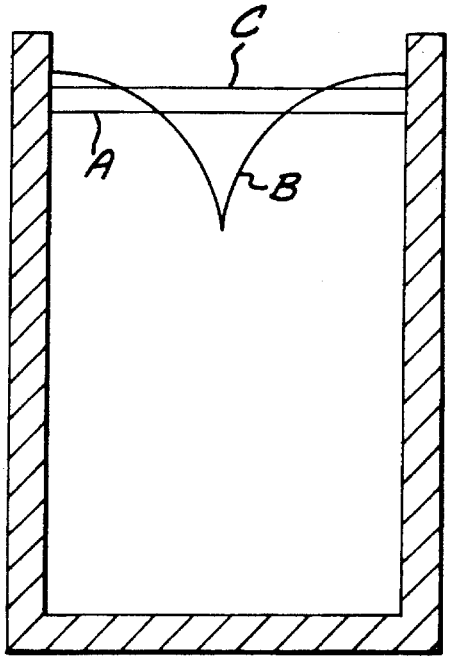
FIG. 1 is a schematic side sectional view of a melt in a crucible before, during, and after conventional impeller mixing.

The present invention is embodied in a process and apparatus for preparing a composite material by incorporating particulate nonmetallic reinforcement into a molten mass of the matrix material. To produce an acceptable composite material, the molten metal must wet the surface of the particulate. If wetting is not achieved, it is difficult to disperse the particulate throughout the mass of metal, since the particulate rises to the surface even after being forced below the surface by a mixer. Unwetted particulate also results in unsatisfactory mechanical properties of the cast solid composite material, especially for particulate matter having a relatively short ratio of length to thickness, also termed the aspect ratio. For particles having a short aspect ratio on the order of 1–5, there must be good bonding at the interface of the particle and the matrix to achieve good strength and stiffness values. Good bonding cannot be readily achieved in the absence of wetting of the molten matrix to the particles.

Wetting of a metal to a particle is a phenomenon involving a solid and a liquid in such intimate contact that the adhesive force between the two phases is greater than the cohesive force within the liquid. Molten metals such as aluminum and aluminum alloys wet and spread on many typical nonmetallic particulate reinforcement materials under the proper conditions, but the presence of certain contaminants at the surface between the metal and the particles inhibits wetting. Specifically, gas and oxides adhered to a surface inhibit wetting of a molten metal to that surface. It is therefore necessary to minimize the presence and effect of gas and oxides otherwise interposed between the molten metal and the particulate in order to permit the molten metal to wet the surface, thereby retaining the particulate within the molten metal during mixing and casting, and promoting good interfacial bonding properties after casting and solidification.

There are several sources of gas in a molten mixture of the metal and particulate that can interfere with wetting of the metal to the particles. Gas is adsorbed on the surface of the particles that are initially provided. Even after thorough cleaning, gases immediately re-attach themselves to the surface of the particles, even in high vacuum. These layers inhibit the subsequent wetting. Gas bubbles readily attach themselves to the surfaces of the particulate after immersion in the molten metal, since the surface sites tend to be most favorable for the attachment or nucleation of bubbles.

Gas is present in the molten metal in a dissolved or physically entrained state. Gaseous species are also present as oxides on the surface of the metals. The preferred metal for use in the present invention, aluminum, is well known for the rapid formation of an oxide on the surface of the liquid or solid metal, and this oxide directly inhibits wetting.

Gas can also be introduced into the molten mixture of metal and particulate by the mixing technique used to mix the two together to promote wetting. In the prior practice for mixing, a paddle-type or ship's propeller-type of mixing impeller has been used to promote mixing and wetting of the metal and particulate. The melt is stirred at a high rate to form a vortex above the impeller, and then the particulate is added into the sides or bottom of the vortex. It has been thought that the metal flow along the sides of the vortex promotes mixing.

Instead, it has now been found that the presence of a vortex inhibits wetting, the ultimate objective of the mixing procedure, by incorporating gas into the mixture. Gas is physically drawn into the molten mixture by the vortex, most noticeably when there is a gaseous atmosphere above the melt but also when the mixing is accomplished in vacuum.

FIG. 1 graphically illustrates the effect of vortex mixing and the incorporation of gas into a composite melt. An experiment was performed to determine the extent of incorporation of gas into the molten mixture. A mixture of aluminum and silicon carbide particulate was melted in a crucible, and line A represents the surface of the melt. The melt was then rapidly stirred in argon with a conventional mixing impeller to generate a vortex at the surface, and line B represents the shape of the surface during mixing while the deep vortex characteristic of rapid stirring of metals is present. When mixing was stopped, the surface level of the melt, represented by line C, was significantly higher than before mixing, line A. The difference was due to gas that had been drawn into the melt by the vortex and entrapped during the mixing process. This physical entrainment is particularly significant for melts containing solid particulate, since the gas that is drawn into the melt is preferentially retained at the surface between the particulate and the melt. Thus, while mixing can have the beneficial effect of promoting a distribution of the particles in the melt and wetting, the wrong type of mixing ultimately inhibits the wetting.

The mixing action can also nucleate undesirable gas bubbles in the melt in a manner similar to cavitation. Dissolved or entrapped gases are nucleated into bubbles in the region of low pressure immediately behind the blades of an improperly designed mixing impeller due to the reduced pressure there, and the bubbles preferentially attach to the particulate surfaces, also inhibiting wetting.

The mixing process of the present invention minimizes the incorporation of gases into the melt and the retention of adsorbed, dissolved and entrapred gases in the melt, with the result that there is a reduced level of gases in the melt to interfere with wetting of the metal to the particles.

The mixing process also creates a state of high shear rates and forces between the molten metal and the solid particles in the melt. The shear state helps to remove adsorbed gas and gas bubbles from the surface of the particulate by the physical mechanism of scraping and scouring the molten metal against the solid surface, so that contaminants such as gases and oxides are cleaned away. The shear also tends to spread the metal onto the surface, so that the applied shear forces help to overcome the forces otherwise preventing spreading of the metal on the solid surface. The shearing action does not deform or crack the particles, instead shearing the liquid metal rapidly past the particles.

In the preferred approach, a vacuum is applied to the surface of the melt. The vacuum reduces the incorporation of gas into the melt through the surface during mixing. The vacuum also aids in removing gases from the melt. A vacuum need not be used if other techniques are employed to minimize introduction of gas into the molten metal and to minimize retention of gas in the molten metal. One such approach within the scope of the present invention is that of allowed U.S. patent application Ser. No. 07/598,225, now U.S. Pat. No. 5,028,392, whose disclosure is incorporated by reference.

According to the approach of the '392 patent, a process for preparing a metal matrix composite material comprises the steps of preparing in a closed reactor a mixture of a molten aluminum alloy containing at least some magnesium, and particles that do not dissolve in the molten aluminum alloy, the particles being present in an amount of less than about 35 volume percent of the total mixture; applying a vacuum to the mixture; statically pressurizing the interior of the reactor with nitrogen gas; mixing the mixture of aluminum alloy and particles under the static nitrogen atmosphere to wet the particles with the alloy; and removing the nitrogen gas from the mixture.

A key feature of that approach is the static pressurization of the interior of the reactor with nitrogen during mixing. The nitrogen gas appears to have two important effects. First, it reduces the content of oxygen below the level where it is harmful to the wetting process. Even the most pure nitrogen gas contains some small amount of oxygen, and the use of static pressurization is critical to avoiding an adverse effect of that small amount of oxygen. By "static" pressurization is meant that the reactor is filled with nitrogen to some selected pressure above ambient pressure and then sealed.

Thus, the process of the '892 patent for preparing a metal matrix composite material comprises the steps of preparing in a closed reactor a mixture of a molten aluminum alloy, and particles that do not dissolve in the aluminum alloy; and wetting the molten aluminum alloy to the particles under conditions such that the partial pressure of oxygen gas is below the pressure required for the formation of aluminum oxide and the partial pressure of nitrogen gas is above that required for the formation of aluminum nitride.

Returning to the discussion of the present approach generally, preparation of a composite of a metallic alloy, preferably aluminum or an aluminum alloy, reinforced with particles of a nonmetallic material, preferably silicon carbide, begins with melting the aluminum alloy. A wide range of standard wrought, cast, or other aluminum alloys may be used, as, for example, 6061, 2024, 7075, 7079, and A356. There is no known limitation to the type of alloy.

Before the particles are added, it is preferred but not necessary to clean the melt to remove oxides, particles, dissolved gas, and other impurities that inhibit wetting. In one approach, a nonreactive gas such as argon gas, or a mixture of nonreactive gas and reactive gas such as argon and chlorine, is bubbled through the melt in a holding tank for a period of time, as about 15 minutes, before particles are added. The gas bubbles to the surface, carrying with it dissolved and entrapped gases, such as hydrogen gas, that diffuse into the gas bubbles as they rise, and also forcing dross floating in the metal to the surface.

Particles of the nonmetallic refractory ceramic material are added to and mixed with the molten metal. The particles must exhibit a sufficiently low degree of degradation by chemical reaction with the molten metal under the conditions of mixing and casting. That is, a particulate that dissolves into the molten metal under all known conditions is not acceptable, nor is a particulate that forms an undesirable reaction product in contact with the molten metal. On the other hand, most nonmetallics react extensively with molten metals at high temperatures, but in many cases the reaction can be reduced to an acceptable level by controlling the temperature of the molten metal to a temperature whereat there is no substantial degree of reaction during the time required for processing.

The preferred nonmetallic reinforcement materials are metal oxides, metal nitrides, metal carbides, metal silicides, and glasses. Of these, silicon carbide and aluminum oxide are of particular interest, as they are readily procured, are inexpensive, and exhibit the necessary combination of physical properties and reactivity so that desirable composites may be made using the present approach.

The amount of particulate added to the melt may vary substantially, with the maximum amount being dependent upon the ability to stir the melt containing the particles to achieve homogeneity. With increasing amounts of particulate, the melt becomes more viscous and harder to stir. Higher amounts of particulate also provide increased surface area for the retention and stabilization of gas within the melt, limiting the ability to prepare a sound, wetted material. The maximum amount of particulate in aluminum alloys has been found to be about 35 volume percent. The size and shape of the particles may also be varied.

A combination of the molten metal and the particles, prior to mixing, is formed by a convenient method. The particles may be added to the surface of the melt or below the surface, although in the latter case the particles typically rise to the surface unless mixing is conducted simultaneously to achieve partial or complete wetting. The particles can also be added with the pieces of metal before the metal is melted, so that the particles remain with the metal pieces as they are melted to form the melt. This latter procedure is not preferred, as it is desirable to clean the melt prior to addition of the particulate. If the particulate is present during cleaning of the melt, the particulate may be carried to the surface with the cleaning gas.

The particulate and the molten metal are mixed together for a time sufficient to wet the molten metal to the particles. The mixing is conducted under conditions of high shear strain rate and force to remove gas from the surface of the particulate and to promote wetting. The mixing technique must also avoid the introduction of gas into the melt, and avoid the stabilizing of entrapped and dissolved gas already in the melt.

Figure 2:
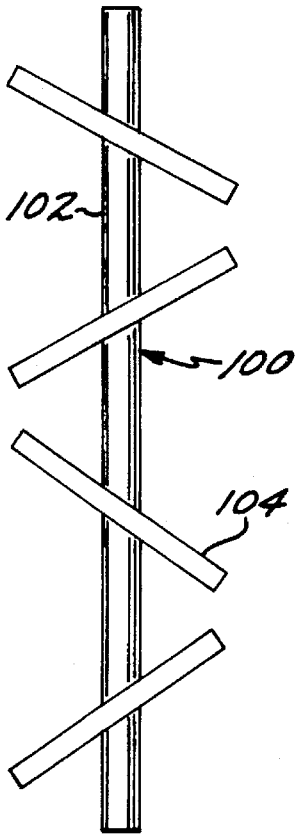
FIG. 2 is an elevational view of a dispersing impeller.

One approach to mixing uses a dispersing impeller immersed into the melt and operated so as to induce high shears within the melt but a small vortex at the surface of the melt. A dispersing impeller meeting these requirements is illustrated in FIG. 2. This dispersing impeller 100 includes a dispersing impeller shaft 102 having a plurality of flat blades 104. The blades 104 are not pitched with respect to the direction of rotation, but are angled from about 0° to about 45° from the line perpendicular to the shaft 102. This design serves to draw particulate into the melt while minimizing the appearance of a surface vortex and minimizing gas bubble nucleation in the melt. Tests have demonstrated that this impeller can be rotated at rates of up to at least about 2500 revolutions per minute (rpm) without inducing a significant vortex at the surface of aluminum alloy melts. A high rate of rotation is desirable, as it induces the highest shear rates and forces in the molten mixture and reduces the time required to achieve wetting.

The melt is mixed with the dispersing impeller for a time sufficient to accomplish wetting of the metal to the particulate and to disperse the particulate throughout the metal. Empirically, a total mixing time of about 70 minutes for batch processing systems has been found satisfactory. For a continuous flow system, substantially all of the volume of molten mixture must be subjected to a high shear state at least once. The preferred approach is to have the mixing impeller sized to the molten composite flow channel so that virtually all of the composite material that passes through the channel is stirred by the impeller. Multiple stages of mixing can be provided to ensure that all of the molten material is mixed.

The temperature of mixing should be carefully controlled to avoid adverse chemical reactions between the particles and the molten metal. The maximum temperature of the metal, when in contact with the particles, should not exceed the temperature at which the particles chemically degrade in the molten metal. The maximum temperature is dependent upon the type of alloy used, and may be determined for each alloy. While the molten alloy is in contact with the particulate, the maximum temperature should not be exceeded for any significant period of time.

For example, the maximum temperature is about 20° C. above the alloy liquidus temperature for silicon carbide particulate alloys containing significant amounts of reactive constituents such as magnesium, zinc, or lithium. The maximum temperature is about 70° C. above the alloy liquidus temperature for common alloys that do not contain large amounts of reactive or stabilizing elements. The maximum temperature is about 100° C. to about 125° C. above the alloy liquidus where the alloy contains larger amounts of elements that stabilize the melt against reaction, such as silicon. If higher temperatures than those described are used, it may be difficult or impossible to melt, mix and cast the composite material mixture because of increased viscosity due to the presence of dissolved matter.

The maximum temperature also depends upon the reactivity of the particulate, which is determined primarily by its chemical composition. Silicon carbide is relatively reactive, and the preceding principles apply. Aluminum oxide is relatively nonreactive in aluminum and aluminum alloys, and therefore much higher temperatures can be used.

In a prior approach termed rheocasting, the metal and particulate were mixed in the range between the solidus and the liquidus of the alloy. In this range, solid metal is formed in equilibrium with the liquid metal, and the solid metal further increases the viscosity and the shear forces, making the mixing even more effective. However, it has now been found that the use of temperatures substantially below the liquidus results in extensive and undesirable segregation of alloying elements in the metallic phase after the composite is solidified. The material also cannot be readily cast using conventional casting procedures.

The molten mixture is therefore maintained in the temperature range of a minimum temperature where there is substantially no solid metallic phase formed in equilibrium with the liquid metal, to a maximum temperature whereat the particles do not chemically degrade in the molten metal. The minimum temperature is about the liquidus of the molten metal, although lower temperatures can be sustained briefly. Temperature excursions to lower temperatures are not harmful, as long as the melt is cast without a solid metallic phase present. For example, when the particulate or alloying additions are added to the melt, there can be a normal brief depression of the temperature. The temperature must be raised above the liquidus temperature before the melt may be cast. Although permitted for brief periods, such temperature excursions are preferably avoided because of the energy cost in restoring the steady state temperature. The maximum temperature is limited by the onset of degradation of the particulate in the liquid metal. Brief excursions to higher temperatures are permitted, as long as they do not cause significant degradation of the particulate, but such higher temperatures should not be maintained for extended periods of time.

After mixing is complete and the molten composite mixture is withdrawn from the mixing apparatus, the composite can be cast using any convenient casting technique. After the composite has been mixed, the melt is substantially homogeneous and the particles are wetted by the metal so that the particles do not rapidly float to the surface. If the composite material is held for a substantial period of time, it may be stirred or agitated to prevent segregation of the particles due to density differences, but the stirring should not introduce gas into the melt. Casting need not be accomplished immediately or with a high-rate casting procedure.

The resulting cast material may be made into products by conventional metallurgical procedures. The composite can be annealed and heat treated. It can be hot worked using, for example, extrusion or rolling in conventional apparatus. The final composite can also recast in foundry operations by any acceptable casting procedure.

Figure 3:
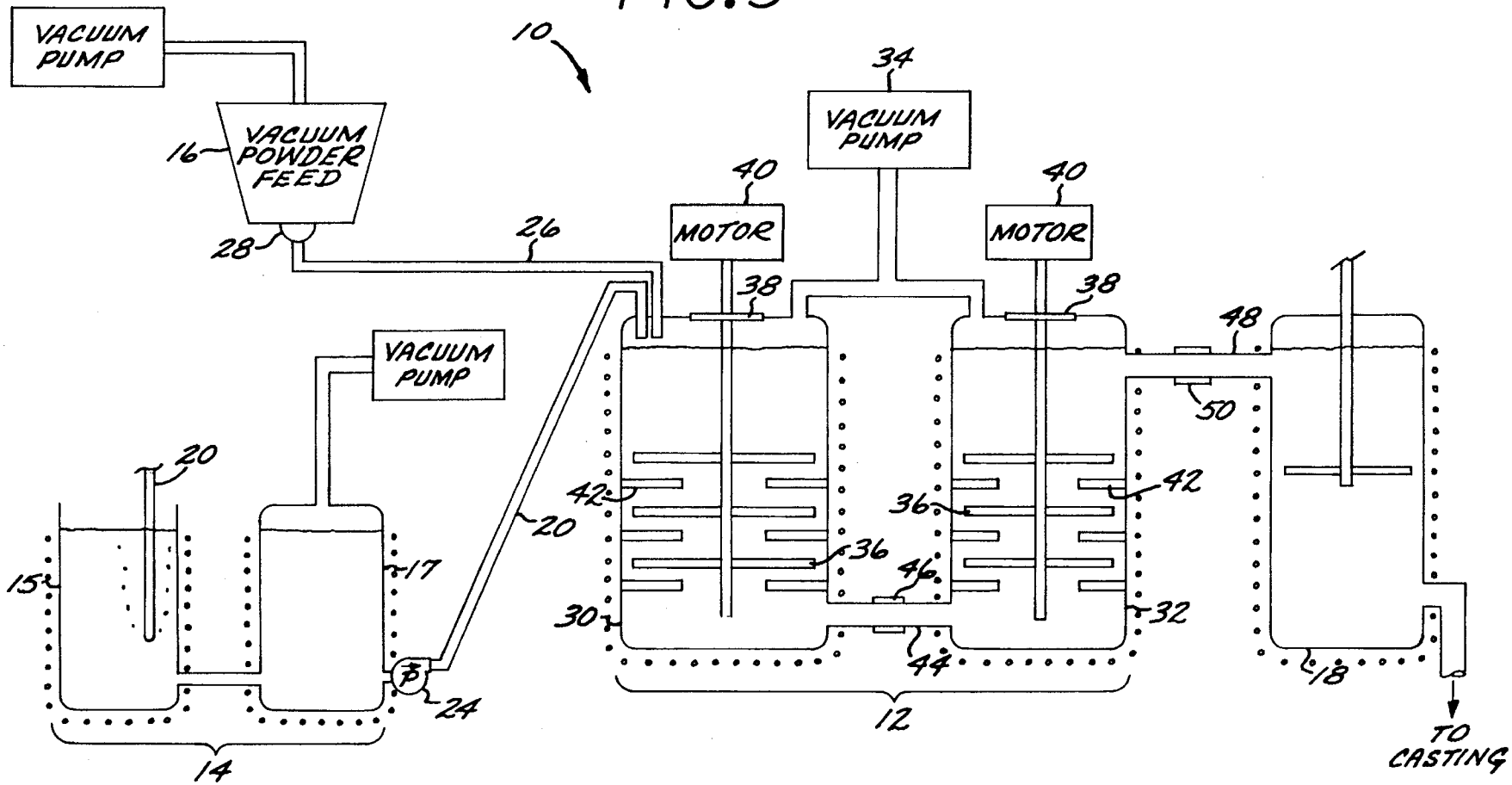
FIG. 3 is a side sectional view of the mixing apparatus using a dispersing impeller, with portions broken away for clarity, and with related apparatus shown diagrammatically.

FIGS. 3–6 illustrate three embodiments of apparatus for preparing composite materials by the continuous flow process of the invention. Referring to FIG. 3, an apparatus 10 includes a mixer 12, a molten metal supply 14 and a particulate feeder 16 that supply the molten matrix alloy and particulate, respectively, to the mixer 12, and a holding furnace 18 that receives the mixed composite material from the mixer 12 and retains it prior to casting.

The mixer 12 includes at least one, and here illustrated two, stages of mixing of the molten metal and the particulate. The molten metal is received from the molten metal supply 14 through a heated conduit 20. The molten metal supply 14 includes a furnace 15 that melts the metallic alloy to be used as the matrix of the composite material. Preferably, the molten metal in the furnace 14 is continuously cleaned by bubbling an inert gas such as argon, or a mixture of inert and reactive gases such as argon and chlorine, through the molten metal with a lance 22 inserted below the surface. The bubbled gas collects any dissolved or entrapped gas, such as hydrogen and oxygen, that may be present in the melt and removes it to the surface, and also floats dross particles that may be present below the surface of the melt. Molten metal flows from below the surface of the furnace 15 to an evacuated degassing unit 17, where an applied surface vacuum removes entrapped gases remaining from the treatment of the furnace 15. Molten metal flows continuously from below the melt surface of the degassing unit 17 through the conduit 20 to the mixer 12.

Because the vacuum and metal levels may vary, and because it is desirable to control the flow rate of metal with reasonable precision, a metal pump 24 is located in the metal conduit 20. The pump 24 is variable speed, and acts both as a pump and a valve in providing a controllable flow rate of molten metal to the mixer 12.

The particulate feeder 16 is a vacuum extruder or vacuum-locked hopper of the type commercially available. The particulate is typically carefully dried in the feeder 16, to ensure that no moisture reaches the mixer 12. The particulate is fed from the feeder 16 through a particulate conduit 26 to the mixer 12. The flow rate of the particulate is governed by a screw extruder 28 or similar device that is operated by a variable speed motor. By varying the rate of operation of the extruder 28 and the pump 24, a preselected total flow and preselected relative amount of particulate and metal to the mixer 12 can be achieved. The conduit 28 may be heated if necessary, but in most practice heating of the conduit 28 is not required because the amount of particulate is relatively smaller than the amount of metal supplied to the mixer 12.

In the embodiment of FIG. 3, the mixer has two stages, each located in a separate chamber and 32. Each chamber 30 is a generally cylindrical, refractory lined steel vessel, with the cylindrical axis vertical. The upper regions of each chamber 30 and 32 are connected to a vacuum pump 34, and pumped to a vacuum of about 30–50 torr. The vacuum reduces the likelihood of introduction of gas into the molten composite material as it is being mixed.

Molten metal enters near the top of the first chamber 30 from the metal conduit 20. The particulate is introduced onto or Just under the surface of the metal through the conduit 26. The first chamber 30 contains a vertically mounted impeller 86 generally of the type shown in FIG. 2, which enters the chamber 30 through a rotational vacuum fitting 88 and is driven by an external variable speed motor 40. The impeller 36 stirs the particulate into the molten metal, to form the first form of the composite material. Care is taken that gas is not introduced into the molten material, as through a vortex produced by the impeller 36. Wetting of the molten metal to the particulate is achieved by the high shear mixing action.

The outer diameter of the blades of the impeller 36 is slightly less than the inner cylindrical diameter of the chamber 30. The relatively small clearance between the impeller 36 and the inner wall of the chamber 30 ensures that all metal flowing downwardly through the first chamber 30 will be subjected to the mixing action. Little, if any, of the metal can reach the bottom of the chamber 30 without passing through the blades of the impeller 35. To reduce the likelihood that metal could pass directly down the interior walls in the clearance gap, baffles 42 extend inwardly from the interior wall of the chamber 30. The baffles 42 are projections that interrupt the flow down the interior wall and force the metal and particulate mixture back toward the center of the chamber 30 so that it is mixed by the next stage of impeller blades.

The mixed composite material is withdrawn from the bottom end of the first chamber 30 through a composite metal conduit 44. A commercial eddy current conductivity monitor 46 is placed in the conduit 44 to monitor the volume fraction of particulate in the flow of composite material. This information is used in a feedback sense to control the flow rates of the particulate feeder 16 and molten metal supply 14 to achieve the desired volume fraction of particulate in the final composite material.

The composite material enters the second chamber 32 from the conduit 44. The second chamber 32 is structured in a manner similar to the first chamber 30 and the same numbering of elements has been used, except that the flow of composite material molten mixture is upward rather than downward. (This flow direction is not significant, and the flow direction in the second chamber could be made the same as in the first chamber with a different conduit arrangement.) At this stage, a significant fraction of the particulate has been wetted by the molten metal, but it is possible that some may not yet be wetted. Passing the composite material axially through the impeller 36 of the second chamber 32 further mixes the composite material to increase the percentage of wetted surface of the particulate. The principle may be extended to additional stages, in the event that mixing by two stages is insufficient for some particular composite materials.

The mixed composite material is withdrawn from the second chamber 32 through a conduit 48, and conducted to the holding furnace 18. The conduit 48 also contains an eddy current device 50 to measure the amount of particulate in the composite material.

The apparatus of FIG. 3 has a two-stage mixer wherein both stages use impeller mixing. Other types of apparatus are possible, and one such alternative embodiment is illustrated in FIG. 4.

Figure 4:
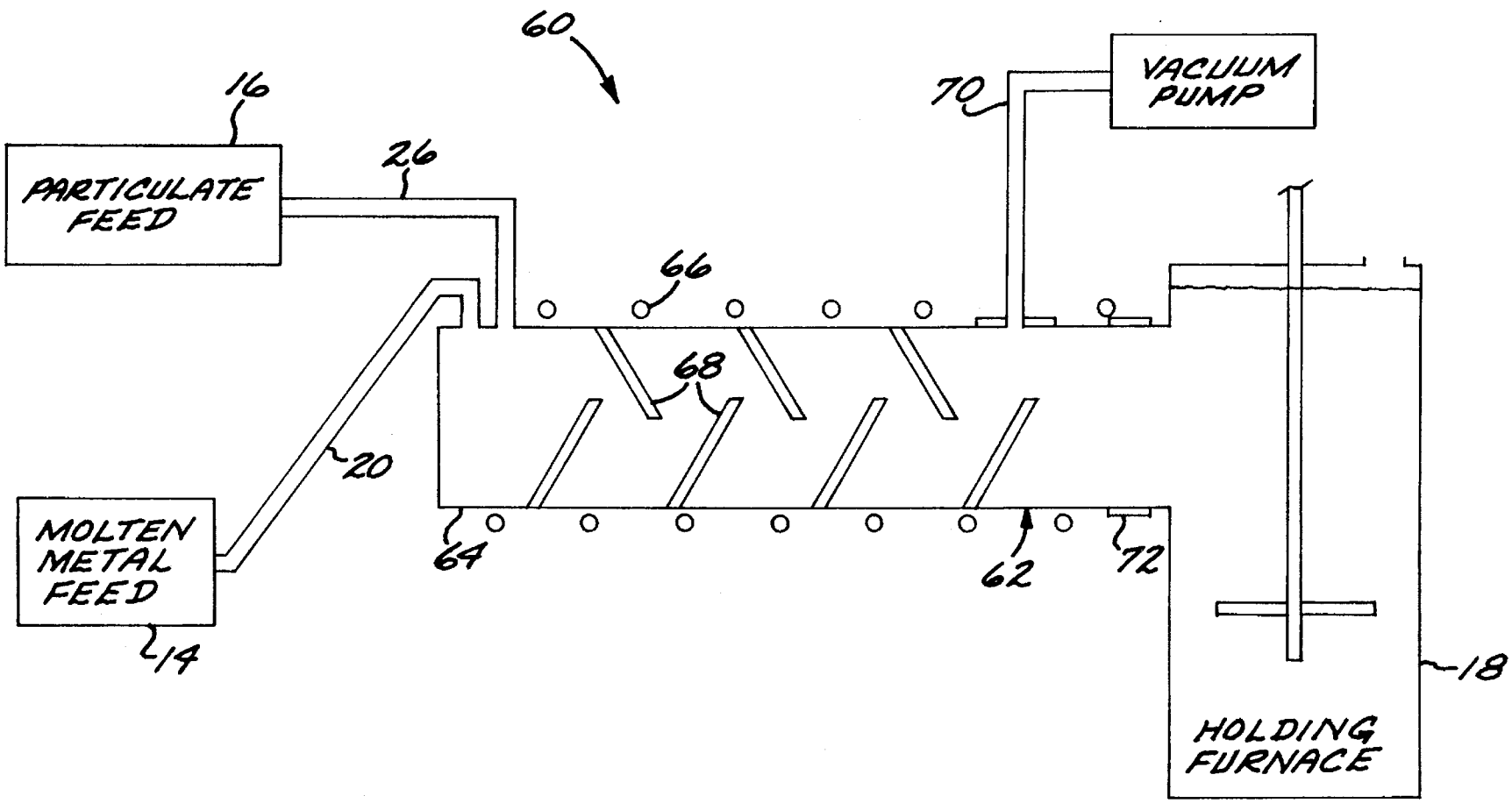
FIG. 4 is a side sectional view of another mixing apparatus.

In an apparatus 60 of FIG. 4, the molten metal supply 14, particulate feeder 16, and holding furnace 18 are as previously described. Here, however, the molten metal and the particulate are introduced into an essentially straight cylindrical mixer 62 whose cylindrical axis is horizontal. The wall 64 of the mixer 62 is formed of a nonconducting material such as aluminum oxide. A high frequency induction coil 56 is wound around the exterior of the cylindrical mixer 62. The induction coil 66, when operated, mixes the molten metal and particulate that is flowing from left to right in the view of FIG. 4, to produce the composite material. A plurality of stationary baffles 68 project inwardly from the interior wall of the mixer 62, to prevent stratification of the composite mixture in regions where the mixing produced by the induction coil is low. The interior of the mixer 62 is pumped by a vacuum line 70, to reduce the possibility of gas accumulating in the system and being incorporated in the molten composite material. Eddy current monitors 72 to determine the amount of particulate in the molten composite are also provided. Although FIG. 4 depicts the mixer 62 as having a relatively short length for the sake of illustration, the mixer 62 is about 20–30 feet in length, with multiple induction coils and sets of baffles.

Figure 5:
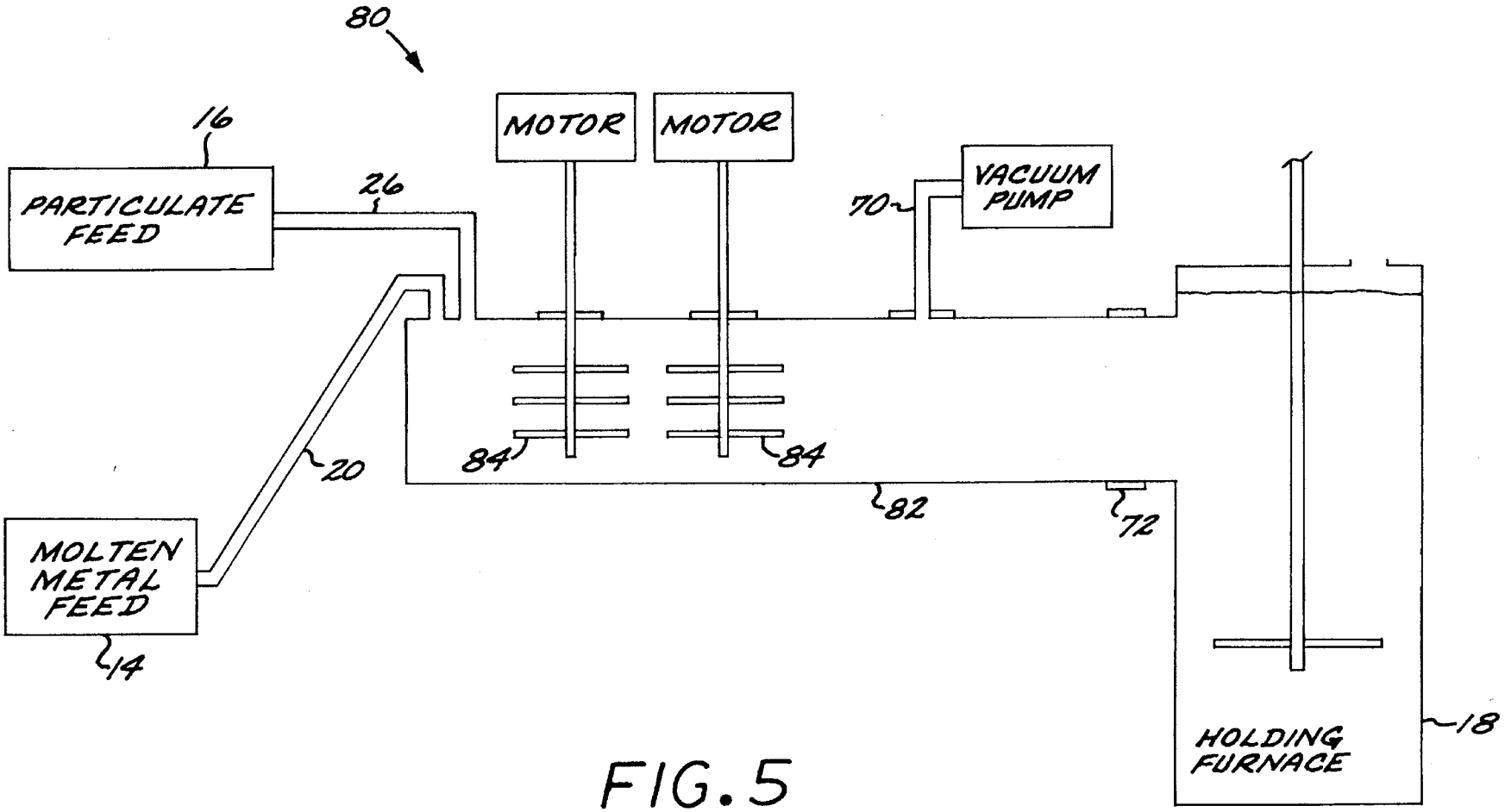
FIG. 5 is a side sectional view of another mixing apparatus.

An apparatus 80 employing a similar horizontal straight line mixer 82 is illustrated in FIG. 5. The construction of this mixer 82 is similar to that described previously, except that one or multiple impellers 84 are operated within the mixer 82 to attain mixing. The impellers can be oriented for side impact mixing, as shown, or for axial mixing as was illustrated in FIG. 3. In this embodiment, multiple stages of mixing are utilized within a single chamber of mixing. A combination of impeller and induction mixing, or other type of mixing, may be used.

Figure 6:
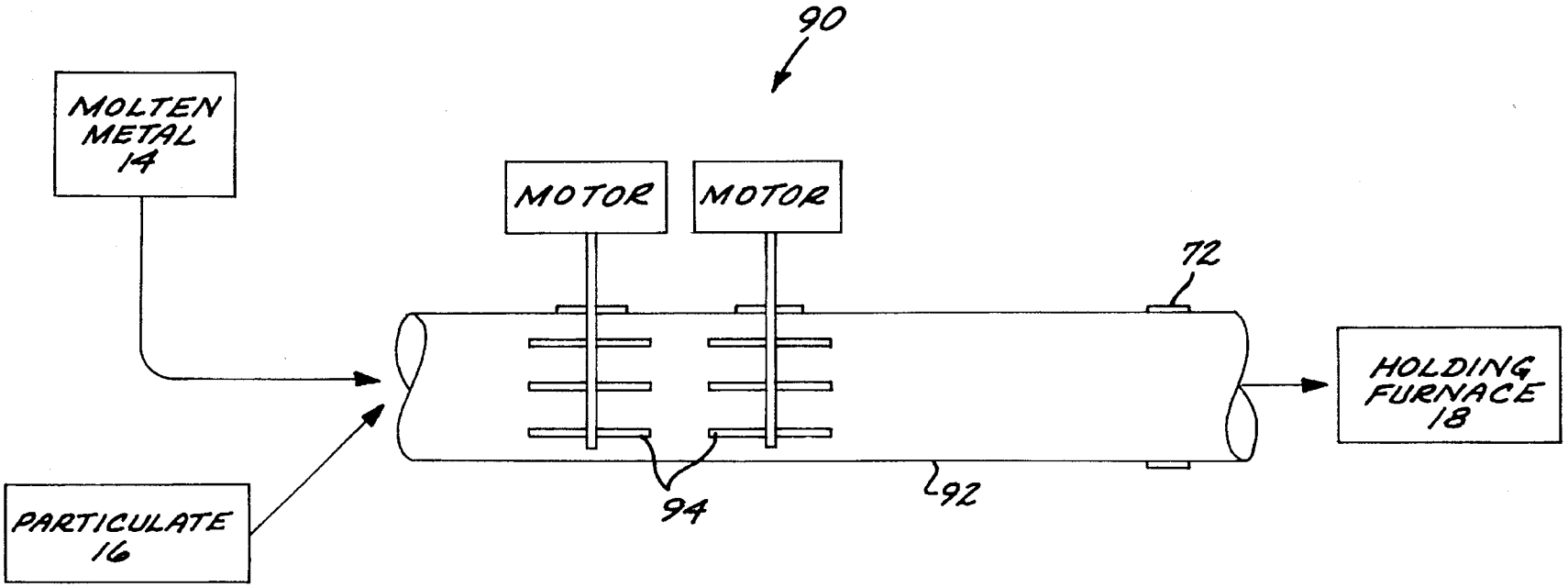
FIG. 6 is a side section view of another mixing apparatus.

Yet another apparatus 90 is illustrated in FIG. 6. The apparatus 90 includes a mixer 92 with impellers 94, but induction mixing could be used. In the apparatus 90, the metal supply 14 is physically above the mixer 92, so that there is a hydrostatic head applied to the metal and composite material within the mixer 92. No vacuum pumping of the mixer 92 is required, as no gas can enter the system. However, great care is required to ensure that gas does not enter through the particulate feeder 16.

The various embodiments of continuous flow apparatus can be used in combination, as for example impeller and induction mixing, as may be required.

It will now be appreciated that the method and apparatus of the present invention produces particulate reinforced composite materials by a melting and casting procedure that is economical and produces high-quality material. Wetting is accomplished by minimizing the effect of gas in the matrix and mixing with a high shear rate. Although particular embodiments of the invention have been described in detail for purposes of illustration, various modifications may be made without departing from the spirit and scope of the invention. Accordingly, the invention is not to be limited except as by the appended claims.

What is claimed is:

1. Apparatus for preparing a continuous flow of a composite of a metallic alloy reinforced with a preselected volume fraction of nonmetallic particles, comprising:

mixing means for mixing a flow of a molten metallic alloy with a flow of a particulate material to wet the molten metal to the particles, under conditions that the particles are distributed throughout a volume of a mixture and the means for mixing being operable to cause the particles and the molten metal to shear past each other to promote wetting of the particles by the metal, the means for mixing being operable to minimize the introduction of gas into, and to minimize the retention of gas within, the mixture of particles and molten metal, at a temperature whereat the particles do not substantially chemically degrade in the molten metal;

metal supply means for introducing a flow of molten metal into the mixing means;

particle supply means for introducing a flow of particulate into the mixing means, the metal flow rate of the metal supply means and the particle flow rate of the particle supply means being controllable; and means for removing a flow of mixed composite material from the mixing means, the means for removing being simultaneously operable with the metal supply means and the particle supply means.

2. The apparatus of claim 1, wherein the mixing means includes an impeller that mixes the molten metal and the particulate material together.

3. The apparatus of claim 1, wherein the mixing means is evacuated by a vacuum pump.

4. The apparatus of claim 1, wherein the mixing means includes a plurality of baffles to aid in mixing the molten metal and the particulate material together.

5. The apparatus of claim 1, wherein the mixing means includes at least two stages of mixing, each stage including means for mixing the molten metal and the particulate together.

6. The apparatus of claim 5, wherein each stage is contained in a separate chamber.

7. The apparatus of claim 14, wherein the stages are within a single chamber.

8. Apparatus for preparing a continuous flow of a composite of a metallic alloy reinforced with a preselected volume fraction of nonmetallic particles, comprising:

a hollow tubular chamber having an inlet at an inlet end of the chamber and an outlet at an outlet end of the chamber, the chamber otherwise being sealed to prevent the introduction of air into the chamber;

a mixer within the chamber that mixes a flow of a molten metallic alloy with a flow of a particulate material to wet the molten metal to the particles without introducing gas into the mixture;

a metal supply source that continuously introduces a flow of molten metal into the inlet of the chamber without introducing air into the chamber;

a particle supply source that continuously introduces a flow of particulate material into the inlet of the chamber without introducing air into the chamber; and a composite removal tube that continuously removes a flow of mixed composite material from the outlet of the chamber without introducing air into the chamber.

9. The apparatus of claim 8, further including a vacuum pump that evacuates the chamber.

10. The apparatus of claim 8, wherein the mixer includes an impeller that mixes the molten metal and the particulate material together.

11. The apparatus of claim 8, wherein the mixer includes at least two impellers that mix the molten metal and the particulate material together.

12. The apparatus of claim 8, wherein the mixer includes a baffle past which the mixture of molten metal and particulate material flows.

13. The apparatus of claim 8, wherein the mixer includes at least two baffles past which the mixture of molten metal and particulate material flows.

14. The apparatus of claim 8, wherein the chamber is oriented vertically so that the inlet is above the outlet.

15. The apparatus of claim 8, wherein the chamber is oriented horizontally so that the inlet and the outlet are at substantially the same height.

* * * * *